US009822688B2

(12) United States Patent
Zhang

(10) Patent No.: US 9,822,688 B2
(45) Date of Patent: Nov. 21, 2017

(54) EXHAUST FLOW DEVICE

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 238 days.

(21) Appl. No.: 14/749,333

(22) Filed: Jun. 24, 2015

(65) Prior Publication Data

US 2016/0376975 A1 Dec. 29, 2016

(51) Int. Cl.

| | |
|---|---|
| ***F01N 1/00*** | (2006.01) |
| ***F01N 3/28*** | (2006.01) |
| ***B01F 5/06*** | (2006.01) |
| *F01N 3/20* | (2006.01) |
| *F01N 3/021* | (2006.01) |

(52) U.S. Cl.

CPC ..... *F01N 3/2892* (2013.01); *B01F 5/0644* (2013.01); *F01N 3/021* (2013.01); *F01N 3/2066* (2013.01); *F01N 2240/20* (2013.01)

(58) Field of Classification Search

CPC .... F01N 13/082; F01N 2270/00; F01N 1/083; F01N 1/086; F01N 1/088; F01N 1/16; F01N 13/185; F01N 2240/20; F01N 3/2892; F01N 3/021; F01N 3/2066; B01F 5/0644

See application file for complete search history.

(56) References Cited

U.S. PATENT DOCUMENTS

| | | | | |
|---|---|---|---|---|
| 3,923,288 | A | 12/1975 | King | |
| 4,487,017 | A | 12/1984 | Rodgers | |
| 4,614,440 | A | 9/1986 | King | |
| 4,848,920 | A * | 7/1989 | Heathe | B01F 5/064 366/339 |
| 5,492,408 | A | 2/1996 | Alfaré | |
| 5,971,603 | A * | 10/1999 | Davis | B01F 5/061 366/337 |
| 6,016,651 | A | 1/2000 | Hammond et al. | |
| 6,074,619 | A | 6/2000 | Schoubye | |
| 6,769,801 | B1 | 8/2004 | Maurer et al. | |
| 7,032,578 | B2 | 4/2006 | Liu et al. | |
| 7,225,623 | B2 | 6/2007 | Koshoffer | |
| 7,469,529 | B2 | 12/2008 | Feuillard et al. | |
| 7,581,387 | B2 | 9/2009 | Bui et al. | |
| 7,621,670 | B1 | 11/2009 | England et al. | |
| 7,793,494 | B2 * | 9/2010 | Wirth | B01F 3/04049 60/274 |
| 8,061,890 | B2 | 11/2011 | Suhner | |
| 8,151,556 | B2 | 4/2012 | Oriet et al. | |
| 8,684,593 | B2 * | 4/2014 | Moser | B01F 5/0451 366/336 |
| 8,939,638 | B2 * | 1/2015 | Palmer | B01F 5/0473 366/337 |

(Continued)

OTHER PUBLICATIONS

Zhang, X., "Exhaust Flow Device," U.S. Appl. No. 14/706,650, filed May 7, 2015, 47 pages.

*Primary Examiner* — Phutthiwat Wongwian
*Assistant Examiner* — Diem Tran
(74) *Attorney, Agent, or Firm* — Julia Voutyras; McCoy Russell LLP

(57) ABSTRACT

Methods and systems are provided for a mixer. In one example, the mixer may include a plurality of projections spatially separated from one another along an exhaust conduit.

18 Claims, 9 Drawing Sheets

(56) References Cited

U.S. PATENT DOCUMENTS

| | | | | |
|---|---|---|---|---|
| 2008/0295497 | A1* | 12/2008 | Kornherr ..... | B01D 53/90 60/286 |
| 2010/0005787 | A1 | 1/2010 | Hosoya et al. | |
| 2011/0036082 | A1 | 2/2011 | Collinot | |
| 2012/0204541 | A1 | 8/2012 | Li et al. | |
| 2013/0269325 | A1 | 10/2013 | Hadden et al. | |

* cited by examiner

EXHAUST FLOW DEVICE

FIELD

The present description relates generally to systems for a mixing device.

BACKGROUND/SUMMARY

One technology for after-treatment of engine exhaust utilizes selective catalytic reduction (SCR) to enable certain chemical reactions to occur between NOx in the exhaust and ammonia ($NH_3$). $NH_3$ is introduced into an engine exhaust system upstream of an SCR catalyst by injecting urea into an exhaust pathway. The urea entropically decomposes to $NH_3$ under high temperature conditions. The SCR facilitates the reaction between $NH_3$ and NOx to convert NOx into nitrogen ($N_2$) and water ($H_2O$). However, issues may arise upon injecting urea into the exhaust pathway. In one example, urea may be poorly nixed into the exhaust flow (e.g., a first portion of exhaust flow has a higher concentration of urea than a second portion of exhaust flow) which may lead to poor coating of the SCR and poor reactivity between emissions (e.g., $NO_x$) and the SCR.

Attempts to address poor mixing include introducing a mixing device downstream of a urea injector and upstream of the SCR such that the exhaust flow may be homogenous. One example approach is shown by Collinot et al. in U.S. 20110036082. Therein, an exhaust mixer is introduced to an exhaust pathway to both reduce exhaust backpressure as exhaust flows though the mixer and increase exhaust homogeneity. The exhaust mixer comprises one or more helicoids which may manipulate an exhaust flow to flow within an angular range of 0 to 30°.

However, the inventors herein have recognized potential issues with such systems. As one example, the mixer introduced by Collinot has a relatively long body and may additionally comprise one or more mixer bodies adjacent to one another. The mixer bodies may vibrate and collide with one another, due to either road conditions or turbulent exhaust flow, which may produce undesired audible sounds and/or prematurely degrade the mixer.

In one example, the issues described above may be addressed by an exhaust gas mixer comprising a most upstream first section, followed consecutively by second, third, and fourth sections. The first and third sections each have a plurality of teardrop-shaped projections. The second and fourth sections each have a plurality of teardrop-shaped projections radially misaligned with the projections of the first and third sections. In this way, it is possible to achieve improved mixing by taking advantage of more normal/binomial distribution of flow that presents numerous points at which the flow can take different paths, similar to a Galton box or quincunx device.

As one example, a mixer with consecutive first, second, third, and fourth sections may be used to increase a homogeneity of an exhaust gas. The portions may be complementary to one another such that an exhaust flow is altered as it passes through each portion of the mixer. The first, second, third, and fourth sections may be physically coupled to a mixer pipe, but not physically coupled to one another. In this way, the mixer can be compact, which may increases mixer stability along with allowing the mixer to be placed in a greater number of locations. Additionally, due to its compact nature, the mixer may produce lower audible sounds due to exhaust turbulence.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3 and 4 are illustrated with identical orientation such that the figures show the relative positioning of the projections with respect to the vertical axis.

FIG. 4 illustrates a face-on view of a third section of the exhaust mixer.

FIGS. 2-5 are shown approximately to scale.

DETAILED DESCRIPTION

Figure 1:
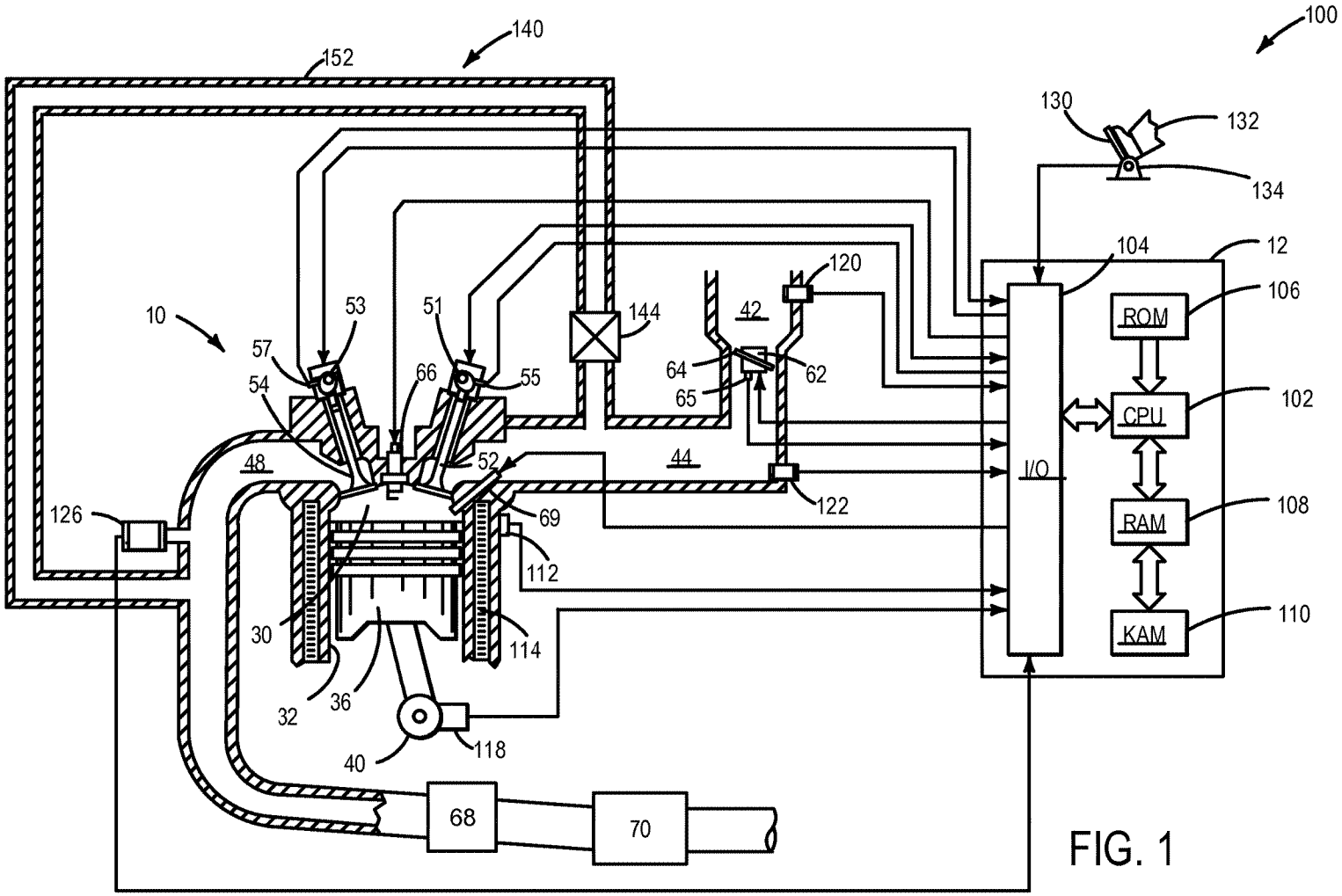
FIG. 1 illustrates an example cylinder of an engine.
Figure 2:
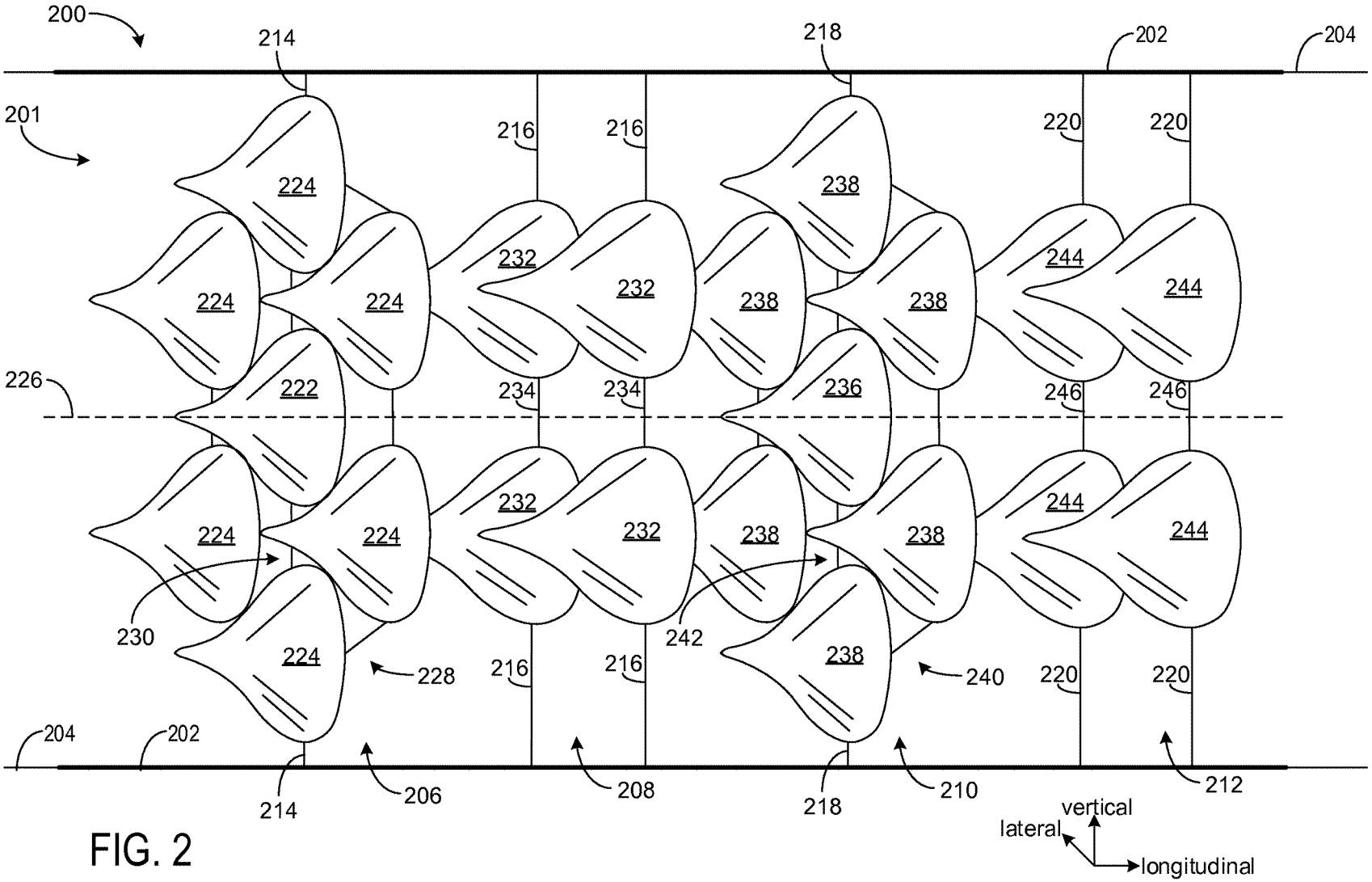
FIG. 2 illustrates a mixer.
Figure 3:
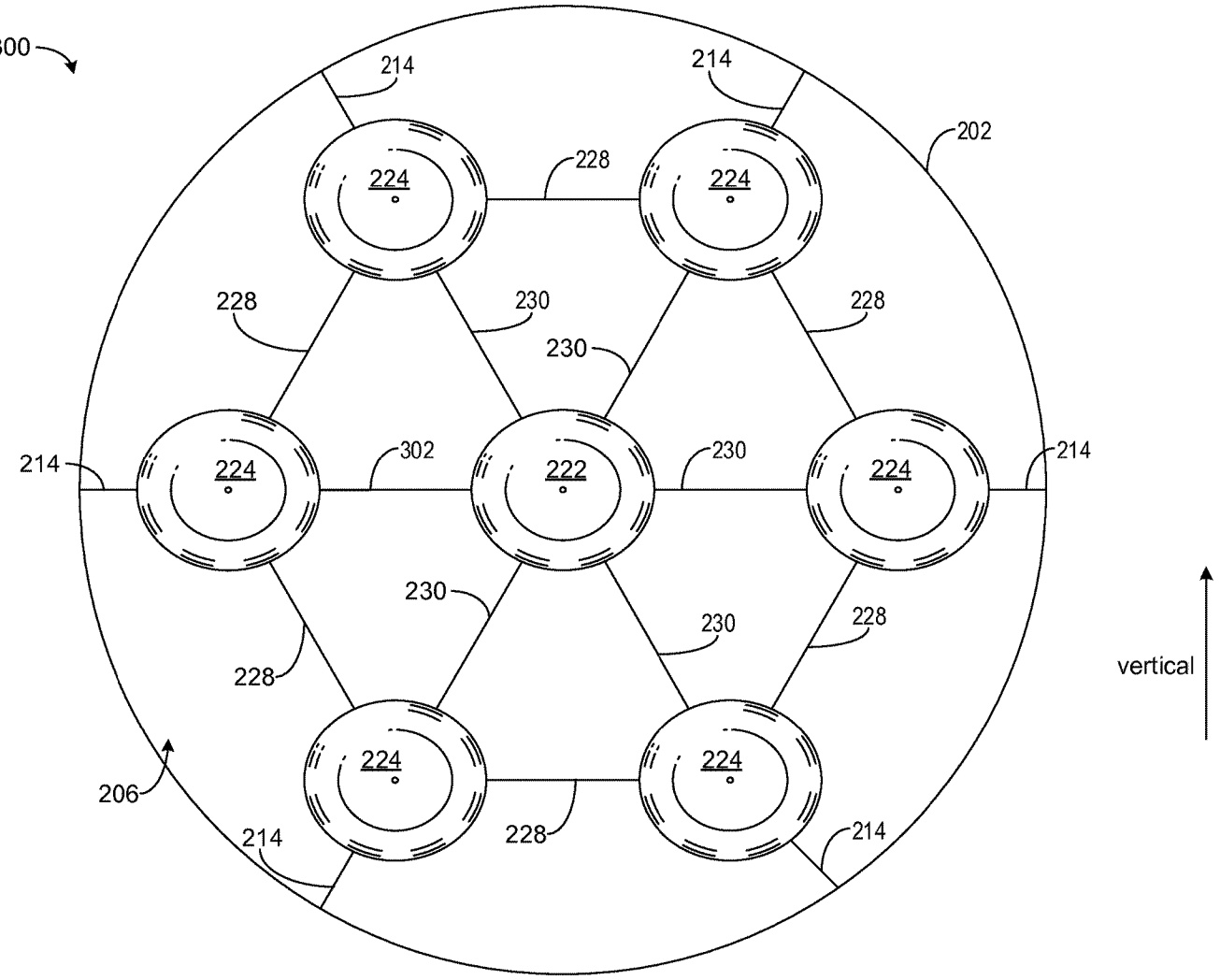
FIG. 3 illustrates a face-on view of a first section of the exhaust mixer.
Figure 4:
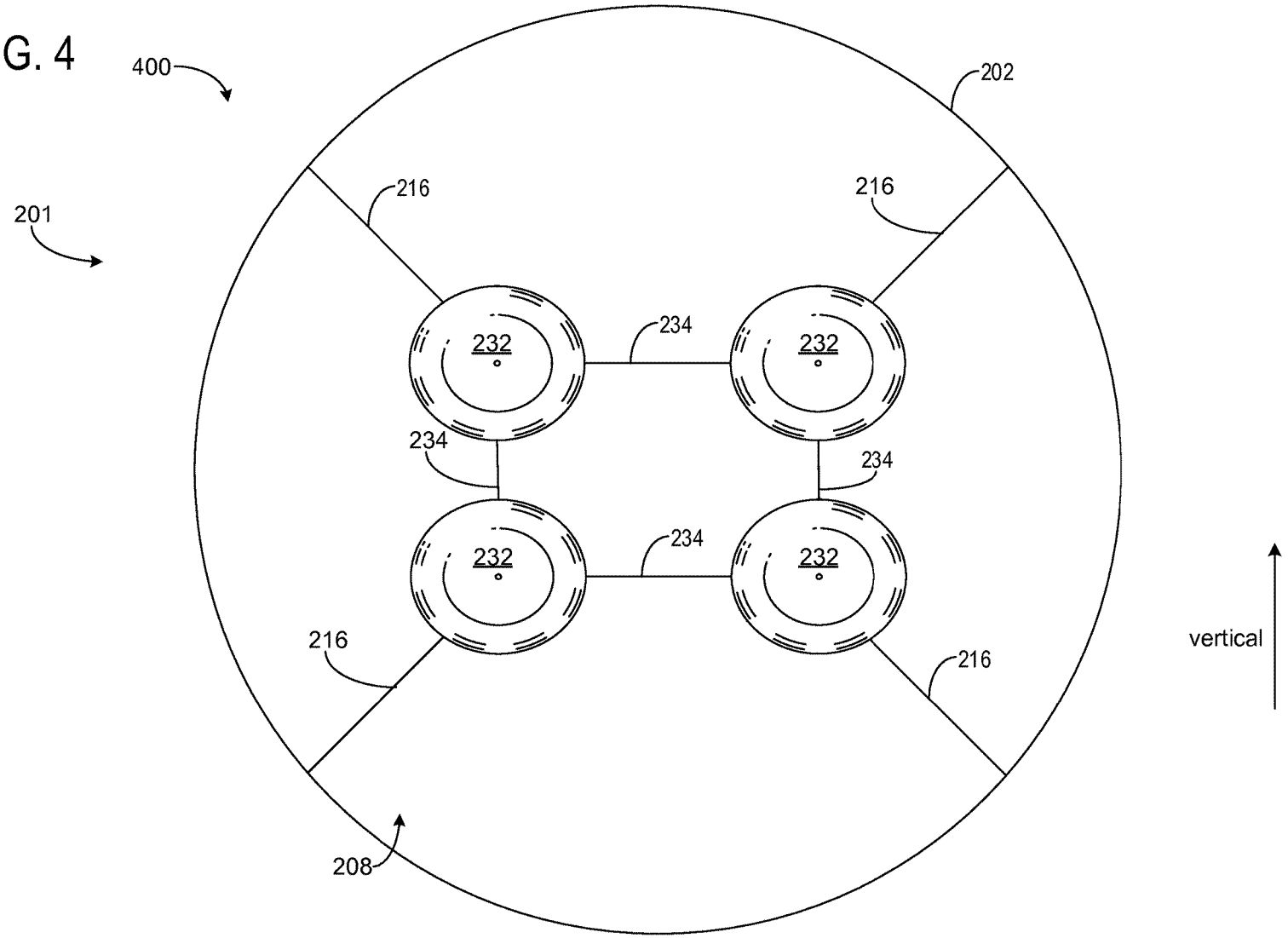
Figure 6:
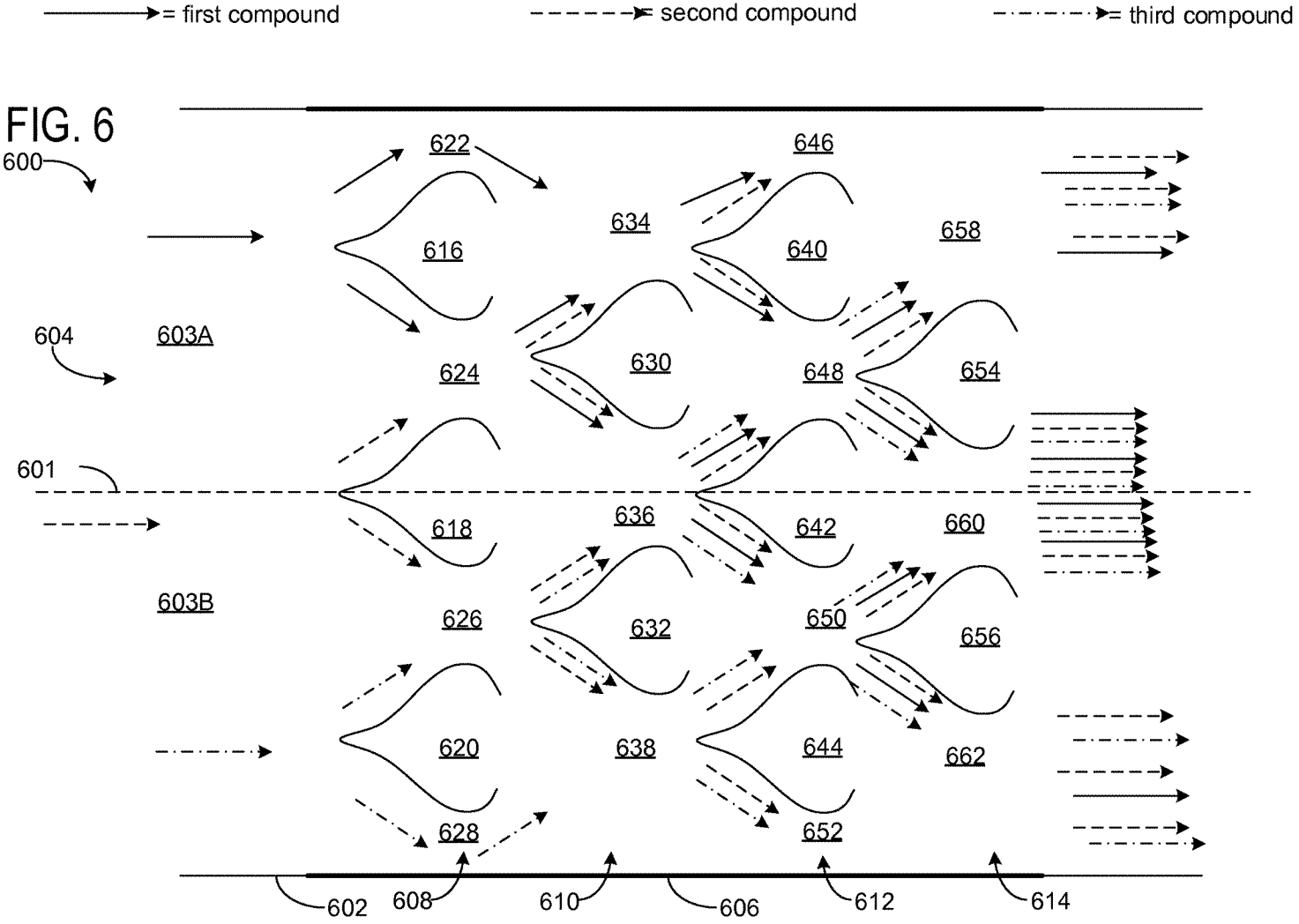
FIG. 6 illustrates an example exhaust flow flowing through a side-on view of the exhaust mixer in the exhaust conduit.
Figure 7:
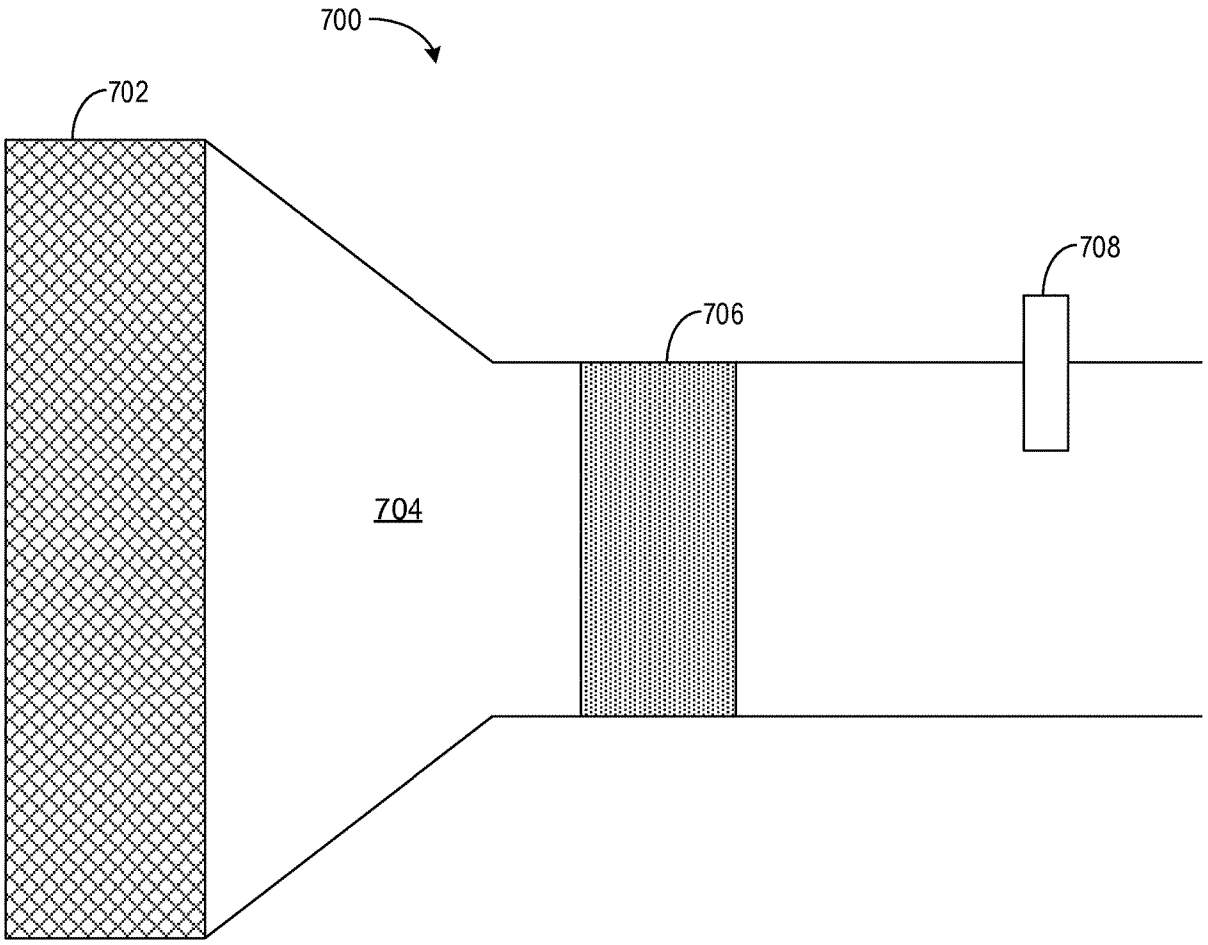
FIG. 7 illustrates an embodiment including the mixer downstream of a particulate filter.
Figure 8:
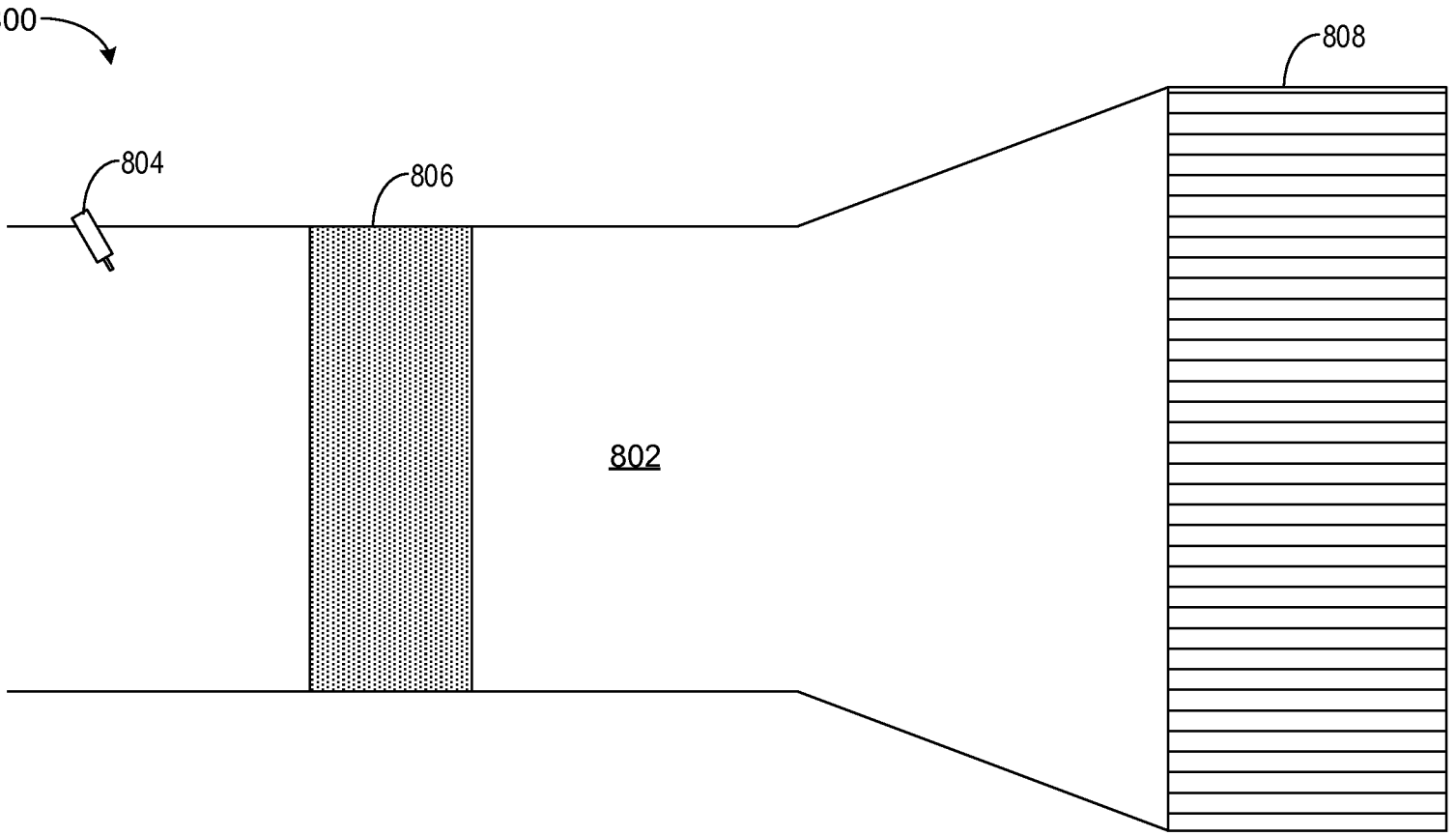
FIG. 8 illustrates an embodiment with the mixer downstream of a urea injector.
Figure 9:
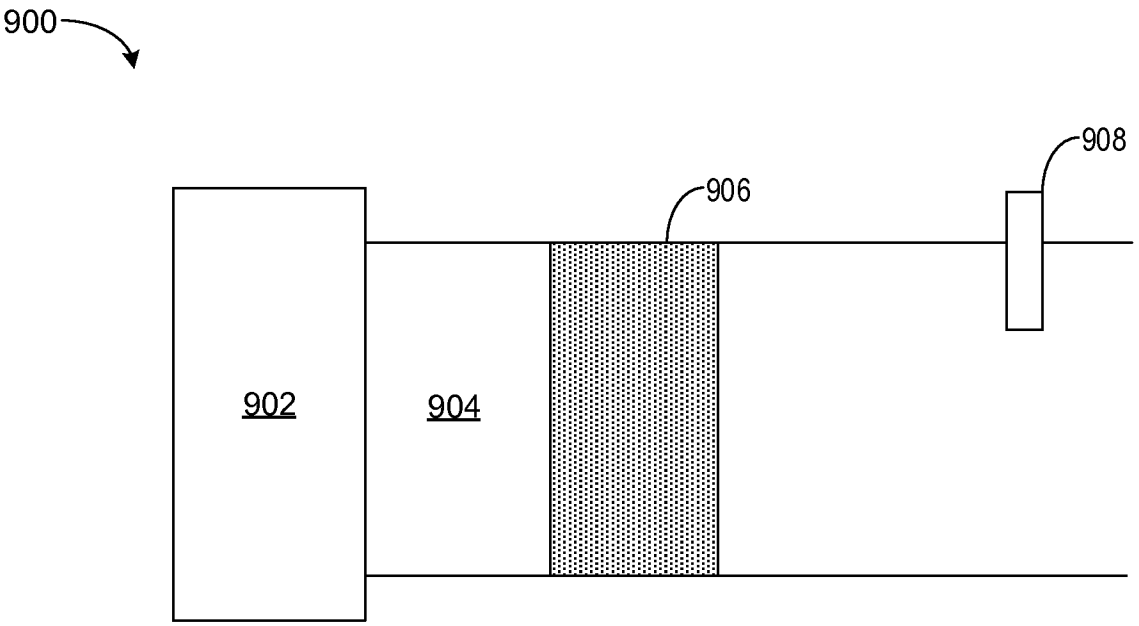
FIG. 9 illustrates an embodiment depicting the mixer upstream of a gas sensor.

The following description relates to systems and methods for a mixer located in an exhaust conduit of a vehicle. The vehicle comprises an engine capable of impelling a vehicle via combustion, as shown in FIG. 1. A product of combustion is exhaust gas, which comprises a variety of constituents. Also shown in FIG. 1, various sensors, actuators, and treatment devices are used to measure or interact with the exhaust gas. In order to obtain accurate measurements of a composition of the exhaust gas, it is desired to increase a homogeneity of the exhaust gas. The mixer depicted in FIG. 2 is capable of perturbing an exhaust flow such that a homogeneity of the exhaust gas is increased. A face-on view a first section of the exhaust mixer is shown in FIG. 3. A face-on view of the second section of the exhaust mixer is shown in FIG. 4. A cross-section of the mixer in an exhaust conduit is shown with respect to FIG. 5. One example of an exhaust gas flow through the mixer is shown with respect to FIG. 6. However, other example flows may exist. The mixer may be located downstream of a particulate filter, downstream of a urea injector and upstream of a selective catalytic reductant (SCR), and upstream of an exhaust gas sensor, as shown in FIGS. 7, 8, and 9, respectively.

It will be appreciated that FIGS. 2, 3, 4, and 5 are drawn approximately to scale, although other relative dimensions may be used, if desired.

Continuing to FIG. 1, a schematic diagram showing one cylinder of a multi-cylinder engine 10 in an engine system 100, which may be included in a propulsion system of an automobile, is shown. The engine 10 may be controlled at least partially by a control system including a controller 12 and by input from a vehicle operator 132 via an input device 130. In this example, the input device 130 includes an accelerator pedal and a pedal position sensor 134 for generating a proportional pedal position signal. A combustion chamber 30 of the engine 10 may include a cylinder formed by cylinder walls 32 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle via an intermediate transmission system. Further, a starter motor may be coupled to the crankshaft 40 via a flywheel to enable a starting operation of the engine 10.

The combustion chamber 30 may receive intake air from an intake manifold 44 via an intake passage 42 and may exhaust combustion gases via an exhaust passage 48. The intake manifold 44 and the exhaust passage 48 can selectively communicate with the combustion chamber 30 via respective intake valve 52 and exhaust valve 54. In some examples, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative examples, the intake valve 52 and/or exhaust valve 54 may be controlled by electric valve actuation. For example, the cylinder 30 may alternatively include an intake valve controlled via electric valve actuation and an exhaust valve controlled via cam actuation including CPS and/or VCT systems.

A fuel injector 69 is shown coupled directly to combustion chamber 30 for injecting fuel directly therein in proportion to the pulse width of a signal received from the controller 12. In this manner, the fuel injector 69 provides what is known as direct injection of fuel into the combustion chamber 30. The fuel injector may be mounted in the side of the combustion chamber or in the top of the combustion chamber, for example. Fuel may be delivered to the fuel injector 69 by a fuel system (not shown) including a fuel tank, a fuel pump, and a fuel rail. In some examples, the combustion chamber 30 may alternatively or additionally include a fuel injector arranged in the intake manifold 44 in a configuration that provides what is known as port injection of fuel into the intake port upstream of the combustion chamber 30.

Spark is provided to combustion chamber 30 via spark plug 66. The ignition system may further comprise an ignition coil (not shown) for increasing voltage supplied to spark plug 66. In other examples, such as a diesel, spark plug 66 may be omitted.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal. The intake passage 42 may include a mass air flow sensor 120 and a manifold air pressure sensor 122 for sensing an amount of air entering engine 10.

An exhaust gas sensor 126 is shown coupled to the exhaust passage 48 upstream of an emission control device 70 according to a direction of exhaust flow. The sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_x$, HC, or CO sensor. In one example, upstream exhaust gas sensor 126 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 70 is shown arranged along the exhaust passage 48 downstream of both the exhaust gas sensor 126 and a mixer 68. The device 70 may be a three way catalyst (TWC), $NO_x$ trap, selective catalytic reductant (SCR), various other emission control devices, or combinations thereof. In some examples, during operation of the engine 10, the emission control device 70 may be periodically reset by operating at least one cylinder of the engine within a particular air-fuel ratio.

The mixer 68 is shown upstream of the emission control device 70 and downstream of the exhaust gas sensor 126. In some embodiments, additionally or alternatively, a second exhaust gas sensor may be located between the mixer 68 and the emission control device 70. The mixer 68 comprises multiple sections, for example two or more sections and in one example exactly four sections, cascaded along an exhaust flow direction in the exhaust passage 48. The mixer 68 may perturb an exhaust flow such that a homogeneity of an exhaust gas mixture is increased as the exhaust gas flows through the mixer 68. The mixer 68 will be described in further detail below.

An exhaust gas recirculation (EGR) system 140 may route a desired portion of exhaust gas from the exhaust passage 48 to the intake manifold 44 via an EGR passage 152. The amount of EGR provided to the intake manifold 44 may be varied by the controller 12 via an EGR valve 144. Under some conditions, the EGR system 140 may be used to regulate the temperature of the air-fuel mixture within the combustion chamber, thus providing a method of controlling the timing of ignition during some combustion modes.

The controller 12 is shown in FIG. 1 as a microcomputer, including a microprocessor unit 102, input/output ports 104, an electronic storage medium for executable programs and calibration values shown as read only memory chip 106 (e.g., non-transitory memory) in this particular example, random access memory 108, keep alive memory 110, and a data bus. The controller 12 may receive various signals from sensors coupled to the engine 10, in addition to those signals previously discussed, including measurement of inducted mass air flow (MAF) from the mass air flow sensor 120; engine coolant temperature (ECT) from a temperature sensor 112 coupled to a cooling sleeve 114; an engine position signal from a Hall effect sensor 118 (or other type) sensing a position of crankshaft 40; throttle position from a throttle position sensor 65; and manifold absolute pressure (MAP) signal from the sensor 122. An engine speed signal may be generated by the controller 12 from crankshaft position sensor 118. Manifold pressure signal also provides an indication of vacuum, or pressure, in the intake manifold 44. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing the methods described below as well as other variants that are anticipated but not specifically listed.

The controller 12 receives signals from the various sensors of FIG. 1 and employs the various actuators of FIG. 1 to adjust engine operation based on the received signals and instructions stored on a memory of the controller.

FIG. 1 depicts an example system comprising a mixer. The mixer comprises four stages (e.g., sections). A first stage and third stage are substantially identical in size and shape. The first and third stages comprise a plurality of projections with a central projection and six outer projections radially displaced from the central projection. The central and outer projections are coupled to one another via supports. The six outer projections are coupled to an outer mixer pipe via legs. A second stage is located between the first stage and the third stage, while a fourth stage, identical to the second stage, is located downstream of the third stage. The second and fourth stages comprise four projections radially misaligned with the projections of the first and third stages. In this way, the stages of the mixer are staggered such that an exhaust gas flowing through the mixer has an increased likelihood of mixing compared to exhaust gas flowing through an exhaust conduit without the mixer. The mixer will be described in greater detail below. Detailed depictions of additional example details of the above described mixer are illustrated in FIGS. 2, 3, 4, and 5.

Turning now to FIG. 2, a system 200 comprises a mixer 201 physically coupled to a mixer pipe 202 in an exhaust conduit 204. The mixer 201 comprises four stages cascaded along an exhaust flow direction in the exhaust conduit 204. The mixer 201 may be substantially similar to mixer 68 and may be used in the embodiment depicted with respect to FIG. 1 as mixer 68.

The mixer 201 may be a single machined piece. The mixer 201 may comprise one or more of a ceramic material, a metal alloy, a silicon derivative, or other suitable materials capable of withstanding high temperatures while also mitigating friction experienced by an exhaust flow such that an exhaust pressure is maintained. Additionally or alternatively, the mixer 201 may comprise of one or more coatings and materials such that exhaust may contact surfaces of the mixer 201 without depositing soot on the mixer 201.

The mixer 201 comprises a first outer mixer component 206 (e.g., first stage), a first internal mixer component 208 (e.g., second stage), a second internal mixer component 210 (e.g., third stage), and a second outer mixer component 212 (e.g., fourth stage). The second stage 208 is positioned between the first stage 206 and the third stage 210. The third stage 210 is positioned between the second stage 208 and the fourth stage 212. Thus, the second stage 208 and the third stage 210 are spatially sandwiched by the first stage 206 and the fourth stage 212. The first stage 206 and the third stage 210 are substantially identical in size, shape, orientation about a central longitudinal axis of exhaust flow, and function. The second stage 208 and the fourth stage 212 are substantially identical in size, shape, orientation about a central longitudinal axis of exhaust flow, and function. The first stage 206, second stage 208, third stage 210, and fourth stage 212 comprise a plurality of identical teardrop shaped projections in one example. In other examples, fewer stages may be used and/or each stage may have differently shaped projections.

The first stage 206, the second stage 208, the third stage 210, and the fourth stage 212 are fixed to the mixer pipe 202, as indicated by a thicker line, via supports 214, 216, 218, and 220, respectively. The first stage 206, the second stage 208, the third stage 210, and the fourth stage 212 are all separate from one another along a direction of exhaust flow, where a distance between each stage is equal. For example, a distance between the first stage 206 and the second stage 208 is equal to a distance between the second stage 208 and the third stage 210. An entirety of the circumference of the mixer pipe 202 is physically coupled to and in face-sharing contact with a portion of the exhaust conduit 204 (e.g., exhaust conduit 48), as indicated by a thinner line. The outer pipe 202 is hermetically sealed to the exhaust conduit 204 such that neither gas nor fluid may pass between the outer pipe 202 and the exhaust conduit 204. The outer pipe 202 may be sealed to the exhaust conduit 204 via an adhesive or forcibly slid into the exhaust conduit.

Supports 214, 216, 218, and 220 are used to hold the first stage 206, the second stage 208, the third stage 210, and the fourth stage 212 in place such that exhaust flow does not alter a position and/or orientation of the first stage 206, the second stage 208, the third stage 210, and the fourth stage 212. Thus, the mixer 201 is stationary and its components do not actuate or rotate in one example.

The first stage 206 comprises supports 214, a central projection 222, and outer projections 224. As depicted, the first stage 206 comprises only six outer projections 224 and only one central projection 222, although in an alternative embodiment more or less projections may be provided. The outer projections 224 are radially displaced from the central projection 222 in a symmetric manner. In this way, a distance between the central projection 222 and any of the outer projections 224 is uniform. Although the first stage 206 is depicted with two supports 214, each of the outer projections 224 may comprise a support physically coupling an outer projection 224 to the mixer pipe 202. In this way, the first stage 206 may comprise six supports 214. It will be appreciated by someone skilled in the art that the first stage 206 may comprise another suitable number of supports (e.g., more or less than six) such that the first stage 206 remains in place.

The first stage 206 further comprises outer legs 228 physically coupling adjacent outer projections 224. Each outer projection 224 has two outer legs 228 of substantially equal length physically coupling the outer projection 224 to adjacent outer projections 224. The first stage 206 also comprises inner legs 230. The inner legs 230 are physically coupled to the central projection 222 and the outer projections 224. Thus, the central projection is physically coupled to six inner legs 230 while each one of the outer projections 224 is physically coupled to only one of the inner legs 230.

The central projection 222 and the outer projections 224 are teardrop shaped in this example. The projections (e.g., central projection 222 and outer projection 224) may have a flat base, or an open base. A tip (e.g., point) of the central projection 222 faces opposite a direction of exhaust flow and directly aligns with a central mixer axis 226. A diameter of the central projection 222 increases from the tip of the central projection 222 until the diameter of the central projection 222 reaches a maximum diameter. A diameter of the central projection 222 begins to decrease after the maximum diameter such that the central projection 222 is teardrop-shaped, with a convex curvature followed by a convex curvature in a direction of exhaust gas flow. The central projection 222 is depicted as being hermetically closed with only an outside surface of the central projection 222 being in contact with exhaust flow. However, in some embodiments, the central projection 222 may comprise a circular opening facing away from and in the direction of the exhaust flow (see FIG. 6). In this way, the central projection 222 comprises an opening along at base of the central projection facing the second stage 232. The central projection 222 may be hollow or filled. The central projection 222 and the outer projections 224 are substantially equal in size and shape.

For example, the projections (e.g., central projection 222 and/or outer projection 224) comprise a tip and a diameter, where the diameter increases from the tip until it reaches a maximum diameter. The diameter decreases from the maximum diameter until it reaches a base of the projection. The base of the projection is flat bottomed and may be closed. The base is may also be a circular opening leading to a hollow interior of the projection.

A cross-section along a vertical axis of the first stage 206 is hexagonal. As described above, the outer projections 224 are equally spaced from the central projection 222. Therefore, similar to a hexagon, the first stage 206 is rotationally symmetric. The outer projections 224 are also equally spaced from the mixer pipe 202 such that the supports 214 of each outer projection 224 are substantially equal in length.

Exhaust gas may flow through an outer space between the outer projections 224 and the mixer pipe 202 (e.g., near the location of supports 214) with or without contacting the outer projections 224 and/or the central projection 222. Exhaust gas may also flow through an intermediate space between each of the outer projections 224 (e.g., near the location of outer legs 228) with or without contacting the outer projections 224 and/or the central projection 222. Lastly, exhaust may flow through an inner space between the outer projections 224 and the central projections 222 (e.g., near the location of inner legs 230) with or without contacting the outer projections 224 and/or the central projection 222.

Exhaust gas flows through the exhaust conduit 204 and reaches the mixer 201 where the exhaust gas may first interact with the first stage 206. The exhaust gas may contact one or more of the central projection 222 and the outer projections 224 before flowing through one or more of the outer space, the intermediate space, and the inner space as described above. Exhaust gas contacting the central projection 222 or the outer projections 224 may have its exhaust flow altered such that a homogeneity of the exhaust gas flowing through the exhaust conduit 204 is increased. An example exhaust flow through the mixer 201 will be described with respect to FIG. 6.

Exhaust gas flows to the second stage 208 after flowing through the first stage 206. The second stage 208 comprises projections 232 substantially identical to the central projection 222 and the outer projections 224 in both size and shape. As depicted, the second stage 208 comprises four projections 232 misaligned with the central projection 222 and the outer projections 224, where in this example the projections are radially misaligned (compare FIGS. 3 and 4). The projections 232 are located directly downstream of the intermediate space between the central projection 222 and the outer projections 224. The projections 232 are equally spaced from the central axis 226. In this way, exhaust gas flowing through the intermediate space has an increased likelihood of contacting projections 232 where a flow direction may be further perturbed.

A cross section along a vertical axis of the second stage 208 is rectangle shaped with the projections 232 located at each corner of the rectangle. The second stage 208 further comprises second stage legs 234 which connect one of the projections 232 to adjacent projections 232. For example, a projection 232 at a first corner is connected to projections 232 at adjacent corners via second stage legs 234 such that the second stage 208 resembles a rectangle, as will be described with respect to FIG. 4.

As described above, the second stage 208 comprises second stage supports 216 which hold the second stage 208 in place directly downstream of the first stage 206 as described above. The second stage 208 is depicted having four second stage supports 216, where each of the projections 232 is physically coupled to at least one of the second stage supports 216. Thus, each one of the projections 232 is coupled to the mixer pipe 202 via at least one of the second stage supports 216.

Exhaust flowing through the exhaust conduit 204 may flow through the second stage 208 via a space between the projections 232 and the mixer pipe 202 or it may flow through spaces between the projections 232. Exhaust gas may also contact the projections 232 before flowing through the space between the projections 232 and the mixer pipe 202 or through the spaces between the projections 232. In this way, exhaust gas may be further perturbed (e.g., perturbed by the first stage 206 and the second stage 208) in order to mix various constituents of the exhaust gas to increase a homogeneity of the exhaust gas.

Exhaust gas flowing through the second stage 208 flows directly toward the third stage 210. The third stage 210 is identical to the first stage 206 in size, shape, and function. A tip of a central projection 236 of the third stage 210 is aligned with the central mixer axis 226, directly downstream of and in alignment with the tip of the central projection 222 of the first stage 206. Thus, the central projection 236 is downstream of the central projection 222 along the central axis 226. Outer projections 238 of the third stage 210 lie downstream and in alignment with the outer projections 224 of the first stage 206. In this way, in a face-on view of the mixer 201, the first stage 206 eclipses the third stage 210 with the central projection 222 of the first stage 206 eclipsing the central projection 236 of the third stage 210 and the outer projections 224 of the first stage 206 eclipsing the outer projections 238 of the third stage 210. Thus, the second stage 208 is also radially misaligned with the third stage 210. Therefore, exhaust gases flowing through the second stage 208 have an increased likelihood of contacting the projections (e.g., central projection 236 and outer projections 238) of the third stage 210 due to the radial misalignment.

The third stage 210 comprises third stage outer legs 240, which are substantially identical to outer legs 228 of the first stage 206. The third stage outer legs 240 are physically coupled to only the outer projections 238. The third stage 210 further comprises third stage inner legs 242, which are substantially identical to inner legs 230 of the first stage 206. The third stage inner legs 242 are physically coupled to both the central projection 236 and the outer projections 238. The third stage supports 218 of the third stage 210 are substantially identical to supports 214 of the first stage 206 and physically couple the outer projections 238 to the mixer pipe 202.

Exhaust gas flowing through the third stage 210 flows to the fourth stage 212. The fourth stage 212 is substantially identical to the second stage 208 in size, shape, and function. Therefore, the fourth stage 212 is radially misaligned with the first stage 206 and the third stage 210. In a face-on view of the mixer 201, the projections 244 of the fourth stage 212 are eclipsed by projections 232 of the second stage 208 and fourth stage legs 246 of the fourth stage 212 are eclipsed as well.

In this way, the mixer 201 comprises, in order from most upstream to most downstream, the first stage 206, the second stage 208, the third stage 210, and the fourth stage 212. The second stage 208 is radially misaligned with the first stage 206. The third stage 210 is radially misaligned with the second stage 208 while being radially aligned with the first stage 206. The fourth stage 212 is radially misaligned with the first stage 206 and the third stage 210, while being radially aligned with the second stage 208. As described above, the first stage 206 and the third stage 210 are substantially identical in size, shape, and orientation (e.g., the first stage 206 and the third stage 210 are aligned along the central axis 226 the exhaust conduit 204). The second stage 208 and the fourth stage 212 are substantially identical in size, shape, and orientation.

FIG. 2 depicts a mixer comprising four sections consecutively arranged with substantially identical first and third sections and substantially identical second and fourth sections. FIG. 3 depicts a face-on view of the first section of the mixer.

Turning now to FIG. 3, a face-on view 300 of a first stage (e.g., first stage 206) of a mixer (e.g., mixer 201) is shown. For reasons of brevity, components depicted in FIG. 3 similar to those in FIG. 2 may be numbered similarly. Furthermore, as described above, the third stage 210 is substantially identical to the first stage 206. Thus, structural descriptions in the face-on view 300 of the first stage 206 may also be applied to the third stage 210.

The first stage 206 comprises a central projection 222 with a plurality of outer projections 224 equally spaced from the central projection 222, as described above. The outer projections 224 are physically coupled to a first end of an inner leg 230 and the central projection 222 is physically coupled to a second end of the inner leg 230. As depicted, a single inner leg 230 lies between the central projection 222 and a single outer projection 224. Each inner leg 230 is linear and substantially equal in length. As depicted, originating from the central projection 222, the inner legs 230 are angularly spaced apart from one another by 60 degrees.

The outer projections 224 are further coupled to outer legs 228. The outer legs 228 are physically coupled to adjacent outer projections 224. A combination of the central projection 222 and two inner legs 230 with corresponding outer projections 224 and an outer leg 228 comprises a triangular cross-section. The first stage 206 comprises a hexagonal cross-section.

Supports 214 are located between the mixer pipe 202 and the outer projections 224. The supports 214 are parallel with the inner legs 230. The supports 214 are physically coupled to the outer projections 224 at a first end and physically coupled to the mixer pipe 202 at a second end. In this way, the supports 214 couple the first stage 206 to the mixer pipe 202 and thus, hold the first stage 206 in a located position (e.g., orientation and position remain unchanged relative to other stages of the mixer 201).

As described above, the first stage 206 is located upstream of the second stage 208, the third stage 210, and the fourth stage 212. The second stage 208, the third stage 210, and the fourth stage 212 have been omitted from the face-on view 300. However, if the second stage 208, the third stage 210, and the fourth stage 212 were included, then the second stage 208 would be shown in the spaces between the central projection 222 and the outer projections 224. The third stage 210 would be eclipsed by the first stage 206. The fourth stage 212 would be eclipsed by the second stage 208.

FIG. 3 depicts a face-on view of a first stage of an exhaust mixer. FIG. 4 depicts a face-on view of a second stage of the exhaust mixer.

Turning now to FIG. 4, a face-on view 400 of a second stage (e.g., the second stage 208) of a mixer 201 is shown. For reasons of brevity, components depicted in FIG. 4 similar to those in FIG. 2 may also be numbered similarly. Furthermore, as described above, a fourth stage (e.g., fourth stage 212) is substantially identical to the second stage 208. Thus, structural descriptions of the face-on view 400 of the second stage 208 may also be applied to the fourth stage 212.

The second stage 208 comprises projections 232. As depicted, the projections 232 are arranged in the second stage 208 such that a cross-section of the second stage 208 is rectangle-like. In some embodiments, the cross-section of the second stage 208 may be square. The projections 232 are identical to projections (e.g., central projection 222 and outer projections 224) of the first stage 206. As described above, the projections 232 of the second stage 208 lie downstream of the space between the outer projections 224 and the central projection 222 of the first stage 206 (e.g., downstream of the inner legs 230). Furthermore, the projections 232 are radially misaligned with projections (e.g., central projection 222 and outer projections 224) of the first stage 206. In this way, exhaust gas contacting projections of the first stage 206 has an increased likelihood of contacting projections 232 of the second stage 208.

Second stage legs 234 lie between each of the projections 232. A single leg 234 is coupled to a first projection 232 at a first end and coupled to an adjacent projection 232 at a second end. The number of second stage legs 234 is equal to the number of projections 232. Second stage legs 234 are linear and substantially uniform in length. The second stage legs 234 are evenly separated by 90°.

Second stage supports 216 are between the projections 232 and the mixer pipe 202. The second stage supports 216 are physically coupled to the mixer pipe 202 at a first end and physically coupled to a single projection 232 at a second end. The number of second stage supports 216 is equal to the number of projections 232 in the second stage 208. Second stage supports 216 hold the second stage 208 in place such that an orientation and position of the second stage 208 remain constant.

As described above, the second stage 208 is located upstream of the third stage 210, and the fourth stage 212. The first stage 206, the third stage 210, and the fourth stage 212 have been omitted from the face-on view 400. However, if the first stage 206, the third stage 210, and the fourth stage 212 were included, then the first stage 206 would be upstream of the second stage 208 and the second stage 208 would be shown in the spaces between the central projection 222 and the outer projections 224 of the second stage 208. The third stage 210 would be eclipsed by the first stage 206. The fourth stage 212 would be eclipsed by the second stage 208.

Figure 5:
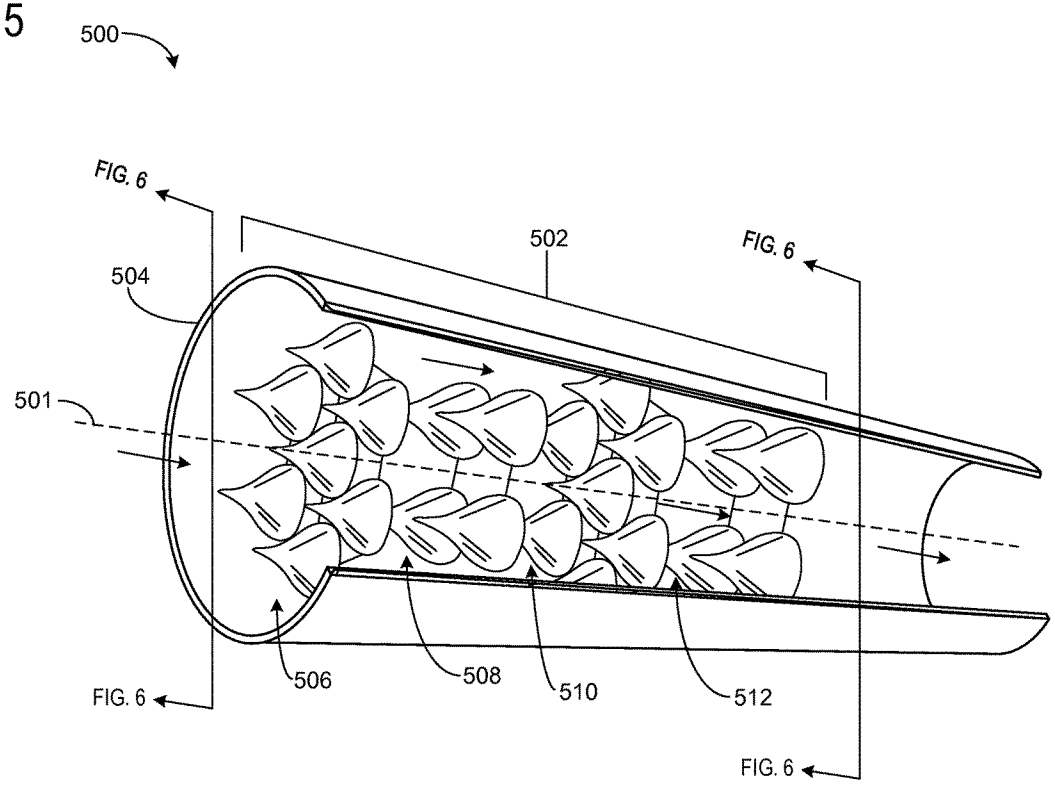
FIG. 5 illustrates an isometric view of the mixer in an exhaust conduit.

FIG. 4 depicts a face-on view of the second stage of the mixer. FIG. 5 depicts an example flow of an exhaust gas interacting with a mixer. The mixer comprising four sections cascaded along an exhaust flow direction in an exhaust passage. First and third sections include respective central and outer projections and where a second and fourth section include a plurality of projections that are radially misaligned from the central and outer projections of the first and third sections.

Turning now to FIG. 5, a system 500 depicts a mixer 502 located within an exhaust conduit 504. In one embodiment, the mixer 502 of system 500 may be substantially similar to mixer 201 of FIG. 2 and/or mixer 68 of FIG. 1. A mixer pipe (e.g., mixer pipe 202 of FIG. 2) has been omitted for reasons of clarity.

The mixer 502 comprises a first section 506, a second section 508, a third section 510, and a fourth section 512. The first section 506 and the third section 510 are substantially identical. The second section 508 and the fourth section 512 are substantially identical. The first section 506, the second section 508, the third section 510, and the fourth section 512 may be substantially identical to the first section 206, the second section 208, the third section 210, and the fourth section 212 of FIG. 2, respectively. The first section 506 is the most upstream section of the mixer 502 consecutively followed by the second section 508, the third section 510, and the fourth section 512.

The first section 506 and the third section 510 each have a central projection spatially surrounded by outer projections identical to the central projection in size and shape. The projections are convex and point in an upstream direction against a flow of exhaust. Arrows located along FIG. 5 indicate a direction of exhaust gas flow in the exhaust conduit 504.

The second section 508 and the fourth section 512 each have projections radially misaligned with the projections of the first section 506 and the third section 510. The projections of the second section 508 and the fourth section 512 are identical in shape and size to the projections of the first section 506 and the third section 510.

A tip of the central projection for the first section and the third section align on a central axis 501. The central axis 501 is located along a center of the exhaust conduit 504. The central axis 501 runs through a space between the projections of the second section 508 and the fourth section 512.

The first section 506, the second section 508, the third section 510, and the fourth section 512 are fully separated from each other, but are all coupled through a pipe (e.g., a mixer pipe 202 of FIG. 2) in which the mixer 502 is fixed. The mixer 502 comprises free spaces between each of the first section 506, the second section 508, the third section 510, and the fourth section 512. The free spaces do not comprise other mixer elements and are occupied by empty space. The first section 506, the second section 508, the third section 510, and the fourth section 512 are aligned with and rotationally symmetrical about the central, longitudinal axis 501.

Arrows indicate a general direction of exhaust gas flow flowing through the exhaust conduit 504. As depicted, the portions of the mixer 502 are staggered, similar to a Galton box. For example, exhaust flowing through an opening of the first section 506 has an increased likelihood of interacting with a surface of the second section 508. In general, the position and orientation of the first section 506, the second section 508, the third section 510, and the fourth section 512 decrease the likelihood for exhaust not to mix in the exhaust conduit 504.

FIG. 5 depicts an entirety of an exhaust mixer located within an exhaust conduit. FIG. 6 depicts an example flow of an exhaust gas interacting with a mixer. The mixer may manipulate the exhaust flow similar to a Galton box.

Turning now to FIG. 6, a system 600 depicts an exhaust conduit 602 guiding exhaust gas towards an exhaust mixer 604. System 600 is illustrative by nature and represents one example exhaust flow through the exhaust mixer 604. It will be appreciated by someone skilled in the art that other exhaust flows through the mixer may be realized based on engine load, exhaust temperature, etc. For example, as exhaust temperature increases, mixing through the mixer 502 may be increased due to an increase velocity of exhaust flow.

In one embodiment, the exhaust mixer 604 of system 600 may be substantially similar to mixer 201 with respect to FIG. 2 and/or to mixer 68 with respect to FIG. 1. FIG. 6 is a side-on view of the mixer 604 and depicts an outline of a structure of the mixer 604 and its components. As shown, the mixer 604 has an anfractuous cross-sectional profile in order to increase mixing of compounds in an exhaust flow. Dashed line 601 represents a center of the exhaust conduit 602, illustratively separating a top half 603A from a bottom half 603B of the exhaust conduit 602.

Exhaust conduit 602 (e.g., exhaust passage 48) comprises the exhaust mixer 604. The exhaust mixer 604 is physically coupled to the exhaust conduit 602 via a mixer pipe 606, as described above. The exhaust conduit 602 houses an entirety of the exhaust mixer 604 and the mixer pipe 606.

Exhaust gas flowing through the exhaust conduit 602 comprises various compounds. As depicted in FIG. 6, a first compound is represented by a solid line arrow, a second compound is represented by a large dash arrow, and a third compound is represented by a small dash arrow. The various compounds in the exhaust gas may include one or more of oxygen, $CO_2$, soot, fuel, urea, nitrogen, etc. Thus, it is possible to for a greater number than three compounds to flow through the exhaust conduit 602. A direction of the compounds and the exhaust flow is indicated by the arrows.

Exhaust gas upstream of the mixer 604 is heterogeneous. The three depicted components of the exhaust gas are separated prior to flowing through the mixer 604. Upon reaching the exhaust mixer 604, the exhaust gas interacts with a first portion 608 of the exhaust mixer 604. The exhaust gas interacts with and passes through various components of the first portion 608 before flowing to a second portion 610.

The second portion 610 also interacts with the exhaust gas and allows the exhaust gas to flow through its various gaps (e.g., spaces) in order to flow downstream to a third portion 612. The third portion 612 interacts with exhaust gas substantially identically to the first outer portion 608. Exhaust gas flows into and around the third portion 612 before flowing downstream to the fourth portion 614. The fourth portion 614 interacts with the exhaust gas in a manner substantially identical to the second portion 610. Exhaust gas flows into and around the fourth portion 614 before flowing to various instruments located downstream of the mixer 604. FIGS. 7, 8, and 9 depict embodiments of various instruments located downstream of the mixer 604. An example of exhaust flow through the mixer 604 with reference to specific components of the mixer 604 will be described below.

As exhaust begins to flow into the mixer 604, the first compound may flow into a first top projection 616, the second compound may flow into a first central projection 618, and the third compound may flow into a first bottom projection 620. A flow direction of the first compound is altered by the first top projection 616 to direct a portion of the first compound toward space 622 and a remaining portion of the first compound to space 624. Space 622 is located between the mixer pipe 606 and the first top projection 616. Space 624 is located between the first top projection 616 and the first central projection 618.

Exhaust flowing through the space 622 may also collide with the mixer pipe 606 to further alter a flow direction of the exhaust gas before flowing to a space 634 of the second portion 610. Exhaust flowing through the space 624 flows past the first portion 608 and into a space between the first portion 608 and the second portion 610 of the exhaust mixer 604 in the top half 603A before flowing toward a second top projection 630 of the second portion 610.

A flow direction of the second compound is altered by the first central projection 618 to direct a portion of the second compound toward the space 624 and a remaining portion of the second compound toward space 626. Space 626 is located between the first central projection 618 and the first bottom projection 620. The second compound flowing toward the space 624 may mix with the first compound prior to flowing to the space between the first portion 608 and the second portion 610 of the exhaust mixer 604. A mixture of the first and second compounds may flow toward the second top projection 630 of the second portion 610. The second compound flowing to the space 626 flows through the first portion 608 and into a space between the first portion 608 and the second portion 610 in the bottom half 603B before flowing toward a second bottom projection 632 of the second portion 610.

A flow direction of the third compound is altered by the first bottom projection 620 to direct a portion of the third compound toward the space 626 and a remaining portion of the second compound toward space 628. Space 628 is located between the first bottom projection 620 and the mixer pipe 606 in the bottom half 603B of the mixer 604. The third compound flowing toward the space 626 may mix with the second compound prior to flowing to the space between the first portion 608 and the second portion 610 of the exhaust mixer 604 in the bottom half 603B. The mixture of the second and third compounds may flow toward the second bottom projection 632 of the second portion 610. The third compound flowing to the space 628 collides with the mixer pipe 606 to further alter a flow direction of the exhaust gas prior to flowing to a space 638 of the second portion 610.

Exhaust flowing through the mixer 604 interacts with the first portion 608 as described above and flows to the second portion 610. The first portion 608 is designed such that exhaust interacting with projections of the first portion 608 have an increased likelihood of interacting with projections of the second portion 610.

Exhaust flowing into the second portion 610 has a greater homogeneity than exhaust flowing into the first portion 608. As a result, a mixture of the first compound and the second compound flowing through the space 624 flows into the second top projection 630. The second top projection 630 alters a direction of the mixture of the first compound and the second compound such that a portion flows toward a space 634 and a remaining portion flows to a space 636. Space 634 is located between the second top projection 634 and the mixer pipe 606 in the top half 634 of the exhaust conduit 602. Space 636 is located between the second top projection 630 and the second bottom projection 632 (i.e., directly downstream of the first central projection 618. Exhaust gas flowing to the space 634 may mix with exhaust gas from the space 622 (e.g., first compound) to further mix the exhaust gas and perturb a direction of the exhaust flow.

A mixture of the second compound and the third compound flowing through the space 626 flows in the second bottom projection 632. The second bottom projection 632 alters a direction of the mixture of the second compound and the third compound such that a portion flows toward a space 636 and a remaining portion flows toward a space 638. Space 638 is located between the second bottom projection 632 and the mixer pipe 606 in the bottom half 603B of the exhaust conduit 602 (i.e., directly downstream of the first bottom projection 620). Exhaust flowing to the space 638 may mix with exhaust gas from the space 628 to further mix the exhaust gas and perturb the exhaust gas flow.

Exhaust gas directed by the second bottom projection 632 to the space 636 may mix with exhaust gas directed by the second top projection 630 to the space 636. In this way, the space 636 comprises a mixture of the first, second, and third compounds, which were originally separated prior to flowing through the exhaust mixer.

Exhaust gas flowing through spaces 634, 636, and 638 flows away from the second portion 610 and toward the third portion 612. The third portion 612 is substantially identical to the first portion 608 and alters exhaust flow in a substantially identical manner. The third portion 612 comprises a third top projection 640, a third central projection 642, and a third bottom projection 644, which are substantially similar to the first top projection 616, the first central projection 618, and the first bottom projection 620, respectively. Spaces 646, 648, 650, and 652 of the third portion 612 are respectively similar locations to spaces 622, 624, 626, and 628 of the first portion 608.

The first and second compounds in the space 634 flow toward the projection 640 or space 646. The first, second, and third compounds in the space 636 flow toward the projection 642, where the first, second, and third compounds are directed to either space 648 of space 650. Second and third compounds in the space 638 flow toward the projection 644 or space 652. Thus, exhaust gas in the space 648 and space 650 comprises the first, second, and third compounds. Exhaust gas in the space 646 and the space 652 comprises the first and second compounds and the second and third compounds, respectively.

Exhaust gas flowing through spaces 646, 648, 650, 652 flows away from the third portion 612 and toward the fourth portion 614. The fourth portion 614 is substantially identical to the second portion 610 and alters exhaust flow in a substantially identical manner. The fourth portion 614 comprises a fourth top projection 654 and a fourth bottom projection 656, which are substantially identical to the second top projection 630 and the second bottom projection 632 of the second portion 610, respectively. The fourth portion 614 further comprises spaces 658, 660, and 662, which are substantially identical to spaces 634, 636, and 638 of the second portion 610.

The first and second compounds in the space 646 flow toward the space 658. The first, second, and third compounds in the space 648 flow toward the fourth top projection 654 where the first, second, and third compounds may be directed to either the space 658 or the space 660. The first, second, and third compounds in the space 650 flow toward the fourth bottom projection 656 where the first, second, and third compounds may be directed to either the space 660 or the space 662. The second and third compounds in the space 652 flow toward the space 662. In this way, each of the spaces 658, 660, and 662 comprises the first, second, and third compounds. Therefore, the homogeneity of the exhaust gas flowing through the mixer 604 continuously increases from the first portion 608, to the second portion 610, to the third portion 612, and to the fourth portion 614.

In this way, the mixer 604 perturbs an exhaust gas flowing through an exhaust conduit 602 via the four portions such that various sections of the exhaust gas collide with one another in order to increase a homogeneity (e.g., a mixing) of the exhaust gas.

In one embodiment, additionally or alternatively, the mixer 604 with the first portion 608, second portion 610, third portion 612, and the fourth portion 614 may adjust an exhaust flow in a manner substantially similar to a Galton box. In one example, flow through the mixer 604 may direct a majority of exhaust gas constituents/compounds toward the center of the exhaust conduit 602 (e.g., distribution of the exhaust constituents along the exhaust conduit may resemble a normal/binomial distribution downstream of the mixer 604). Thus, a mixing of an exhaust gas mixture is increased as a likelihood of flowing different constituents together along a central portion of the exhaust conduit 602 is increased.

FIG. 6 illustrates an example exhaust flow through a mixer. FIGS. 7, 8, and 9 depict various embodiments and/or locations for the mixer to be located in order to increase a homogeneity of exhaust flow.

Turning now to FIG. 7, a system 700 depicts an embodiment of a mixer 706 downstream of a particulate filter 702 and upstream of a soot sensor 708. The soot sensor 708 may send signals to a controller (e.g., controller 12 of FIG. 1) in order to modify various engine actuators accordingly. For example, if a soot sensor detects a soot level being greater than a threshold soot level, then the controller 12 may reduce a torque output of a vehicle such that soot emissions are reduced. In one embodiment, the mixer 706 is equal to the mixer 68 used in the embodiment depicted with respect to FIG. 1.

Particulate filter 702 is upstream of mixer 706. As a result, exhaust flow received by the particulate filter 702 may be increasingly heterogeneous compared to exhaust gas flowing through a mixer (e.g., mixer 706), as described above. The particulate filter 702 releases the exhaust gas into a particulate filter outlet cone 704, upstream of the mixer 706. Exhaust flowing into the mixer 706 experiences a mixing substantially similar to mixing described with respect to FIG. 6. The exhaust downstream of the mixer 706 is increasingly homogenous compared to exhaust upstream of the mixer 706. Exhaust flow is analyzed by the soot sensor 708 in order to determine an amount of soot flowing through the particulate filter 702. Due to the location of the soot sensor, only a portion of the exhaust flow may be analyzed. The increase in homogeneity increases the accuracy of the soot sensor 708 reading.

Turning now to FIG. 8, a system 800 depicts an exhaust conduit 802 with a urea injector 804. The urea injector 804 is upstream of a mixer 806. The mixer 806 is upstream of a selective reduction catalyst (SCR) 808. In this way, the urea may mix with an exhaust gas such that an exhaust gas/urea mixture is more homogenous that it would be without flowing through the mixer 806. By increasing mixing of urea into the exhaust gas, urea coating surfaces of the SCR 808 may increase in uniformity and thereby increase efficiency. The system 800 may be used in the embodiment depicted with respect to FIG. 1. In such an example, the mixer 806 is substantially equal to the mixer 68 and the urea injector 804 is located downstream of the gas sensor 126 and upstream of the mixer 68. The SCR 808 is equal to or located within the emission control device 70.

Turning now to FIG. 9, a system 900 depicts an engine 902 fluidly coupled to an exhaust conduit 904. The engine 902 may be substantially similar to engine 10 of FIG. 1. The engine 902 expels exhaust gas into the exhaust conduit 904 after combusting. The exhaust gas flows through the exhaust conduit 904 before reaching a mixer 906. Exhaust gas is mixed in the mixer 906 before flowing to a gas sensor 908 downstream of the mixer. The gas sensor 908 may be substantially identical to gas sensor 126 of FIG. 1. In this way, the gas sensor 908 may for accurately measure an exhaust gas due to an increase in homogeneity. For example, if the gas sensor 908 is a UEGO sensor, then a more accurate air/fuel ratio may be measured compared to an air/fuel ratio measured by a UEGO sensor of an unmixed exhaust gas.

In this way, a compact, easy to manufacture mixer may be located upstream of a variety of exhaust system components in order to increase an accuracy of a sensor reading or improve efficacy of exhaust after-treatment devices. By staggering a first component, second component, and third component of the mixer and making perforations and gaps of each of the stages complementary to one another, a likelihood of mixing the exhaust gas is increased. Additionally, by manufacturing each component to be separate, a sturdiness of the mixer is increased such that as exhaust passes over the components of the mixer, the components do not vibrate and/or rattle. In this way, the mixer may be quieter that other mixers comprising longer components. The technical effect of placing an exhaust mixer in an exhaust conduit is to improve an exhaust gas mixture homogeneity such that components downstream of the mixer may increase functionality.

While examples are shown with four stages, only a single stage may be used. Further, only two stages may be used, such as a combination of only FIGS. 3 and 4 in one example. Also note that the figures illustrate relative positioning of the various components listed. Components shown directly coupled to one another without any other components therebetween may be referred to a directly coupled. Further, components spaced away from one another may be positioned such that only a void is therebetween and no other components are therebetween.

FIGS. 1-9 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

An exhaust gas mixer comprising a most upstream first section, followed consecutively by second, third, and fourth sections. The first and third sections each have a plurality of teardrop-shaped projections and the second and fourth sections each have a plurality of teardrop-shaped projections radially misaligned with the projections of the first and third sections. Additionally or alternatively, the plurality of teardrop-shaped projections of the first and third sections include a central projection and outer projections are radially displaced from the central projection. The outer projections are equally displaced from the central projection. The first and third sections are rotationally symmetric and further comprise a hexagonal cross-section. The plurality of teardrop-shaped projections of the second and fourth sections include four projections equally spaced from a central axis of the exhaust gas mixer.

The exhaust gas mixer further comprising the second and fourth sections being rotationally symmetric and further comprise a rectangular cross-section. The projections of the first and third section are substantially identical to the projections of the second and fourth sections. The teardrop-shaped projections comprise a tip and an annularly open base. The projections further comprising a maximum diameter located between the tip and the base.

A mixer comprising a first and third section of hexagonal cross-section where the first and third section each comprise a central projection spatially surrounded by six outer projections. The mixer further comprising, additionally or alternatively, a second and fourth section of rectangular cross-section each comprising four projections. The first section is the most upstream section, followed by the second, third, and fourth sections. The projections of the first, second, third, and fourth sections are substantially identical. Additionally or alternatively, the projections comprise a tip and a diameter, where the diameter increases from the tip until it reaches a maximum diameter, and where the diameter decreases from the maximum diameter until it reaches a base of the projection. The base of the projection is flat bottomed and closed. The base is an annular opening leading to a hollow interior of the projection.

The mixer further comprising where the projections of the second section lie directly downstream of spaces between the central projection and the outer projections of the first section and the projections of the fourth section lie directly downstream of spaces between the central projection and the outer projections of the third section. The projections, additionally or alternatively, are convex and point in a direction opposite an exhaust gas flow. The mixer further comprising a mixer pipe spatially surrounding the mixer and physically coupled to each stage of the mixer via supports, and where the first, second, third, and fourth sections are not in direct contact with the mixer pipe.

An engine exhaust system comprising a mixer pipe with four portions. A first portion and third portion comprising a plurality of outer projections radially spaced away from a central projection. A second portion and fourth portion comprising a plurality of projections radially misaligned with the central projection and the plurality of outer projections of the first and third sections. The first portion, the second portion, the third portion, and the fourth portion are spaced away from each other and coupled to the mixer pipe via supports. The mixer pipe perturbs an exhaust gas flowing through an exhaust conduit via the four portions such that various sections of the exhaust gas collide with one another.

An exhaust system comprising an engine with an exhaust pipe and a mixer in the exhaust pipe. The mixer including a first group of upstream teardrop-shaped projections in parallel with exhaust flow and a second group of downstream teardrop-shaped projections in parallel with exhaust flow misaligned with the upstream projections. The teardrop-shaped projections have a circular base opening facing downstream and a point facing upstream.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust gas mixer, comprising:

a most upstream first section, followed consecutively by second, third, and fourth sections;

the first and third sections each having a plurality of teardrop-shaped projections;

the second and fourth sections each having a plurality of teardrop-shaped projections misaligned with the projections of the first and third sections; and where the teardrop-shaped projections comprise a pointed tip and a circular open base.

2. The exhaust gas mixer of claim 1, wherein the plurality of teardrop-shaped projections of the first and third sections include a central projection and outer projections radially displaced from the central projection.

3. The exhaust gas mixer of claim 2, wherein the outer projections are equally displaced from the central projection.

4. The exhaust gas mixer of claim 1, wherein the first and third sections are rotationally symmetric and further comprise a hexagonal cross-section.

5. The exhaust gas mixer of claim 1, wherein the plurality of teardrop-shaped projections of the second and fourth sections include four projections equally spaced from a central axis of the exhaust gas mixer, and wherein the second and fourth sections do not have a central projection.

6. The exhaust gas mixer of claim 1, wherein the second and fourth sections comprise a rectangle cross-section.

7. The exhaust gas mixer of claim 1, wherein the projections of the first and third sections are identical to the projections of the second and fourth sections.

8. An exhaust gas mixer, comprising:

first and third sections of hexagonal cross-section, each comprising a central projection spatially surrounded by six outer projections of the exhaust gas mixer;

second and fourth sections of rectangular cross-section, each comprising four projections without a central projection; and where wherein the first and third sections are rotationally symmetric.

9. The mixer of claim 8, wherein the first section is the most upstream section, followed by the second, third, and fourth sections.

10. The mixer of claim 8, wherein the projections of the first, second, third, and fourth sections are identical.

11. The mixer of claim 10, wherein the projections comprise a tip and a diameter, where the diameter increases from the tip until it reaches a maximum diameter, and where the diameter decreases from the maximum diameter until it reaches a base of the projection.

12. The mixer of claim 11, wherein the base of the projection is flat bottomed and closed.

13. The mixer of claim 11, wherein the base is a downstream facing circular opening leading to a hollow interior of the projection.

14. The mixer of claim 8, wherein the projections of the second section are directly downstream of spaces between the central projection and the outer projections of the first section and the projections of the fourth section are directly downstream of spaces between the central projection and the outer projections of the third section.

15. The mixer of claim 8, wherein the projections are at least partially convex and point in a direction opposite an exhaust gas flow.

16. The mixer of claim 8, further comprising a mixer pipe spatially surrounding the mixer and physically coupled to each stage of the mixer via supports, and where the first, second, third, and fourth sections are not in direct contact with the mixer pipe.

17. An exhaust system, comprising:

an engine having an exhaust pipe; and a mixer in the exhaust pipe including a first group of upstream teardrop-shaped projections in parallel with exhaust flow and a second group of downstream teardrop-shaped projections in parallel with exhaust flow misaligned with the upstream projections, where the projections comprise a pointed tip and a circular open base.

18. The system of claim 17 wherein the teardrop-shaped projections have the circular open base facing downstream and the pointed tip facing upstream.

* * * * *